US006073632A

United States Patent [19]

Tolja

[11] Patent Number: 6,073,632

[45] Date of Patent: Jun. 13, 2000

[54] COMPACT SPHERICAL PORTABLE WATER PIPE FOR USE WITH A STANDARD BEVERAGE BOTTLE

[76] Inventor: Jacopo Tolja, Via Procaccini 45, Milan, Italy, 20100

[21] Appl. No.: 09/105,383

[22] Filed: Jun. 26, 1998

[51] Int. Cl.[7] ..... A24F 1/14; A24F 1/30

[52] U.S. Cl. ..... 131/173; 131/200; 131/214; 131/222; 131/224; 131/225; 131/226; 131/329; 131/330

[58] Field of Search ..... 131/173, 200, 131/214, 222, 224, 225, 226, 329, 330

[56] References Cited

U.S. PATENT DOCUMENTS

| | | | |
|---|---|---|---|
| 110,594 | 12/1870 | Selfe | 131/173 |
| 690,655 | 1/1902 | Khan | 131/173 |
| 2,454,436 | 11/1948 | Dietz | 131/214 |
| 4,031,905 | 6/1977 | Dunn | 131/173 |
| 4,161,954 | 7/1979 | Fornaciari | 131/173 |

*Primary Examiner*—Stanley S. Silverman
*Assistant Examiner*—Michael P. Colaianni

[57] ABSTRACT

A smoking pipe formed of a spherical body having a top cavity for receiving combustibles, a shank tube receiving cavity, and a mouthpiece tube receiving cavity. An air passage connects the shank tube receiving cavity and the top cavity, and an air passage connects the mouthpiece tube receiving cavity to an exit hole at a lower portion of the spherical body. The shank tube is inserted into the shank tube receiving cavity and the mouthpiece tube is inserted into the mouthpiece tube receiving cavity. The spherical body, when placed over a standard beverage bottle such that the shank tube extends into the bottle interior, forms a substantially air tight seal with the inner rim of the bottle top. Operation as a water pipe is thereby effected.

2 Claims, 4 Drawing Sheets

COMPACT SPHERICAL PORTABLE WATER PIPE FOR USE WITH A STANDARD BEVERAGE BOTTLE

CROSS REFERENCES TO RELATED APPLICATIONS

A search on "Prior Art" has been done, this is the result of the search.

D346673: Water pipe
U.S. Pat. No. 3,882,875: SMOKING PIPE
U.S. Pat. No. 4,216,785: Water pipe or bong
U.S. Pat. No. 5,080,113: Water pipe
U.S. Pat. No. 5,738,116: Fluid-cooled smoking device
U.S. Pat. No. 5,476,110: Water pipe
U.S. Pat. No. 4,096,868: Smoking apparatus and methods of constructing and utilizing same
U.S. Pat. No. 4,682,610: Water pipe
U.S. Pat. No. 4,244,383: Smoking device
U.S. Pat. No. 4.041,960: Liquid filtered smoking device
U.S. Pat. No. 3,872,872: Compact water pipe

BACKGROUND OF THE INVENTION

The Compact Spherical Portable Waterpipe fits on any standard bottle neck for carrying out a practical water pipe function.

BRIEF SUMMARY OF THE INVENTION

A spherical shape fits onto a circular hole at the top opening of a standard beverage bottle, centers itself automatically and creates a virtually airtight contact surface. Upon this basis we invented the Compact Spherical Portable Water Pipe.

The Compact Spherical Portable Water Pipe include three parts. The Spherical main body, a "shank" (big tube), a "bit" (small tube also the mouthpiece). By simply inserting the "shank" and the "bit" into their respective holes in the main spherical body, then by placing it over a standard bottle containing sufficient amount of water, the Compact Spherical Portable Water Pipe is ready for use.

DETAILED DESCRIPTION

Figure 1:
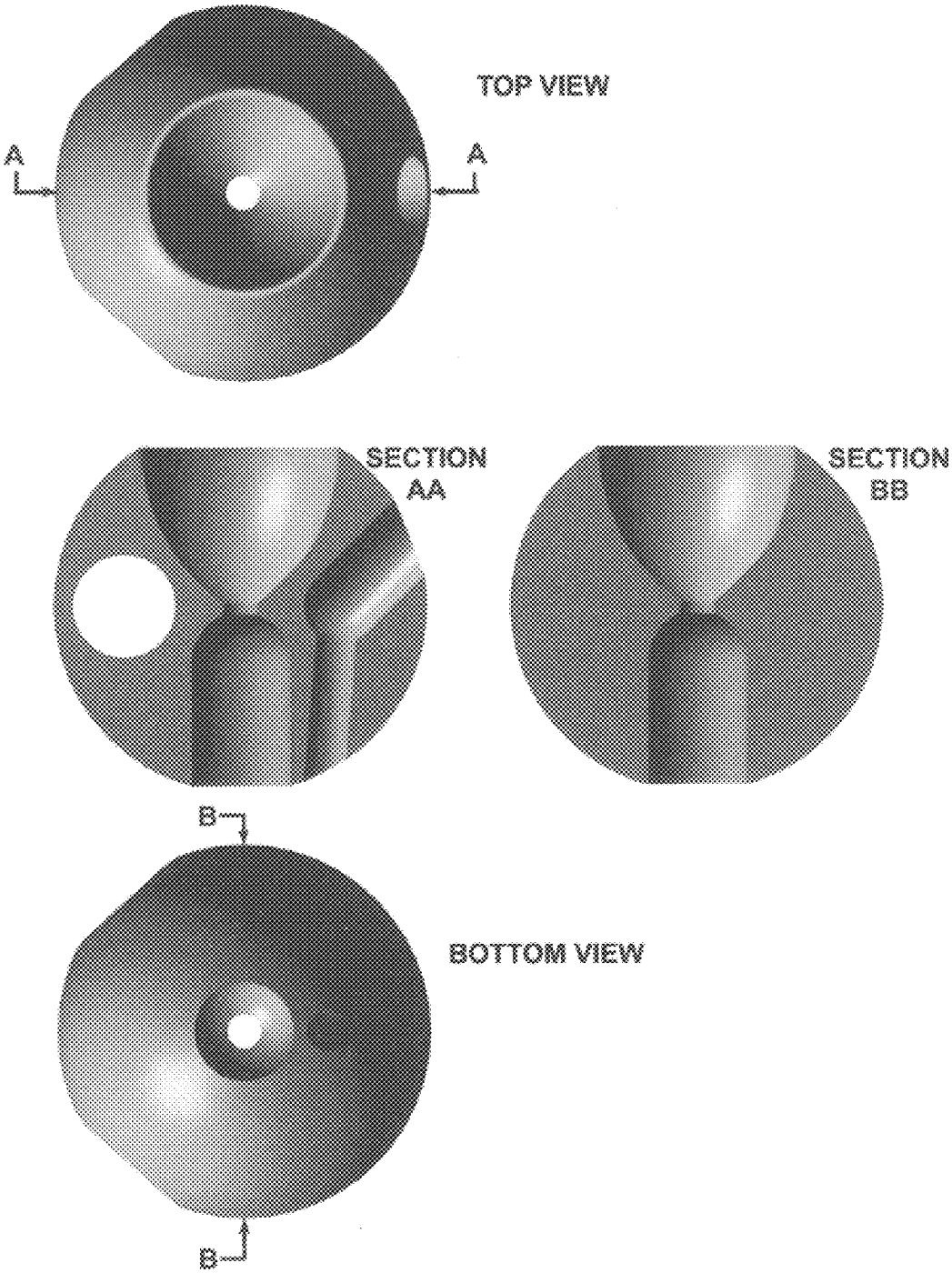
FIG. 1 is a collection of 4 views of the spherical main body: (from the top) Top View with marking for section AA, Section AA, Section BB, Bottom View with marking for section BB.
Figure 2:
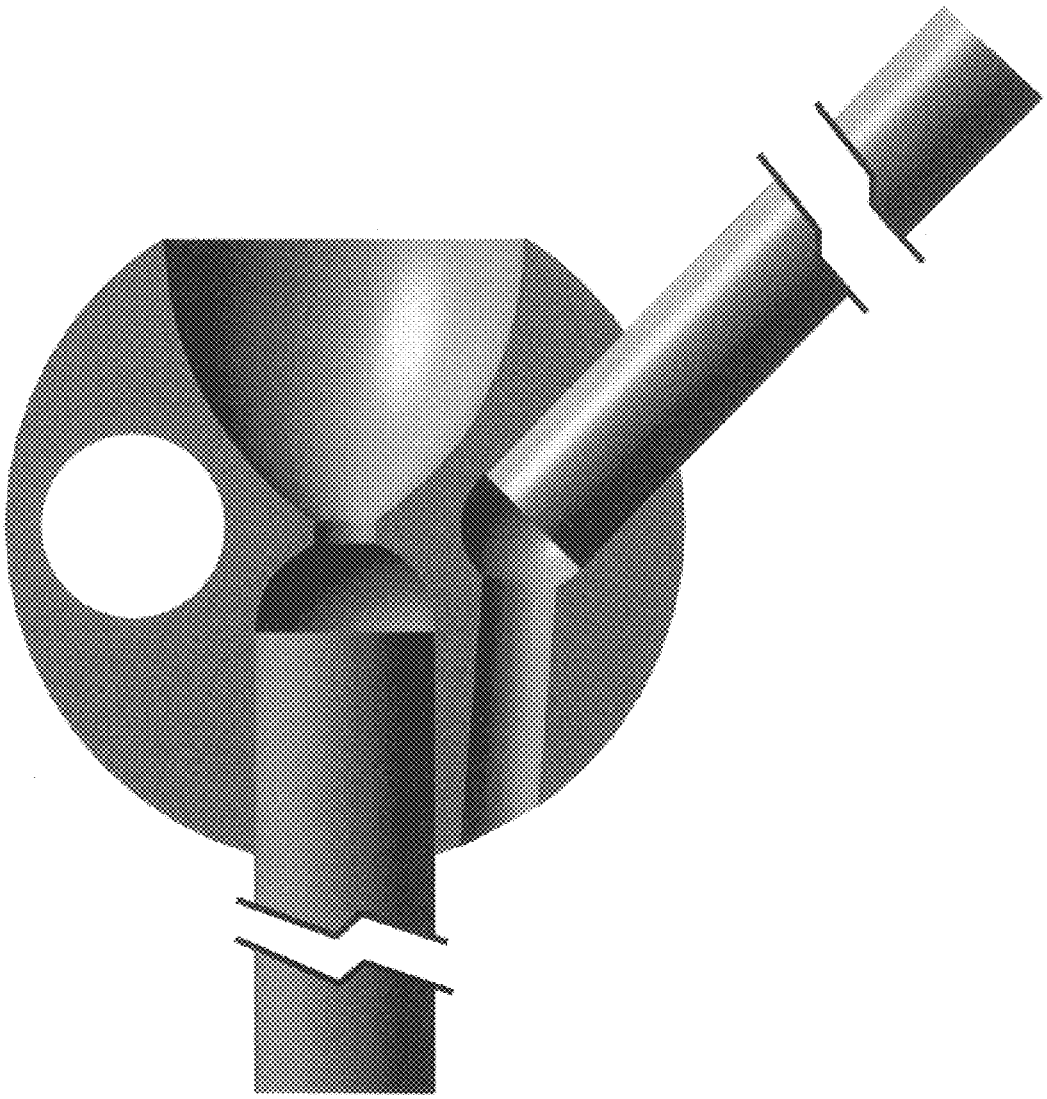
FIG. 2 is a detailed Section AA view of the main spherical body showing the tubes insertion in related cavities.
Figure 3:
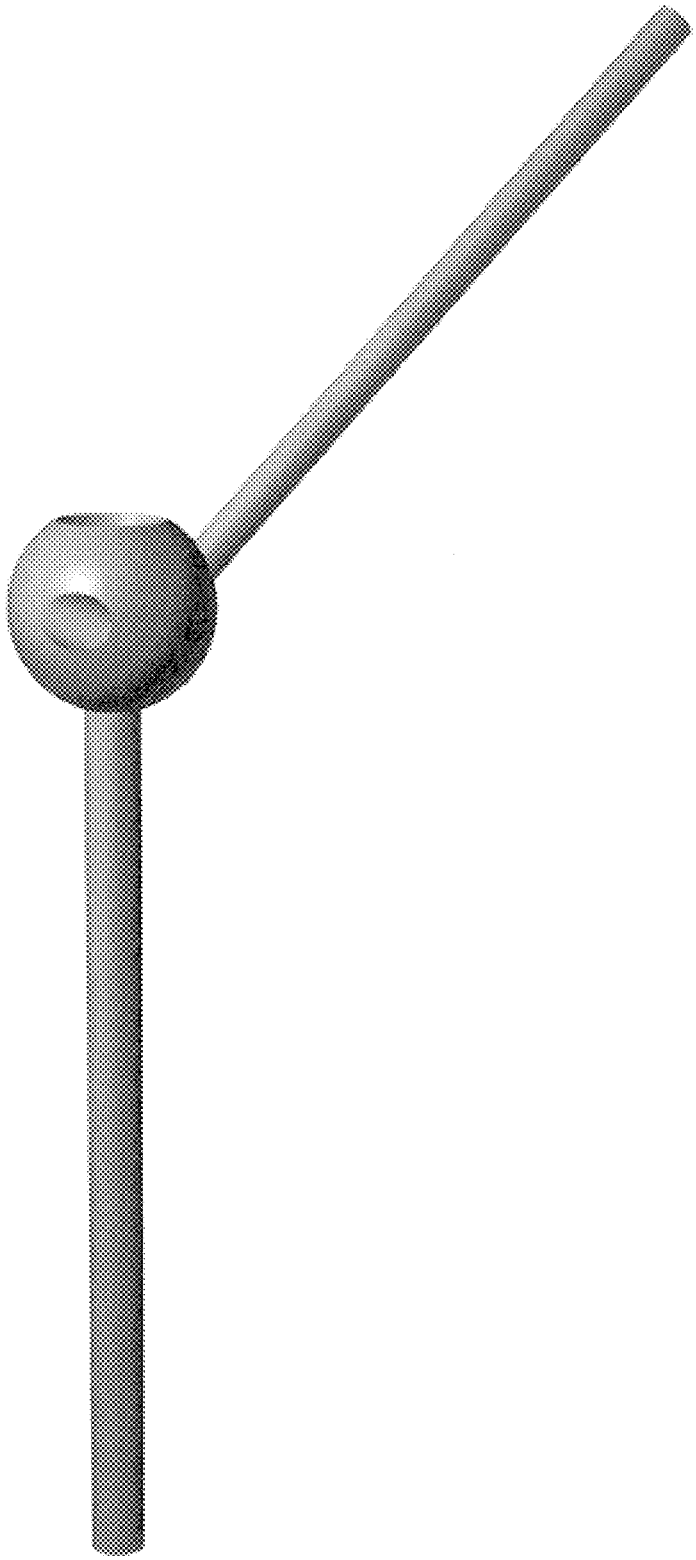
FIG. 3 is a prospective view of the Compact Spherical Portable Water Pipe mounted.
Figure 4:
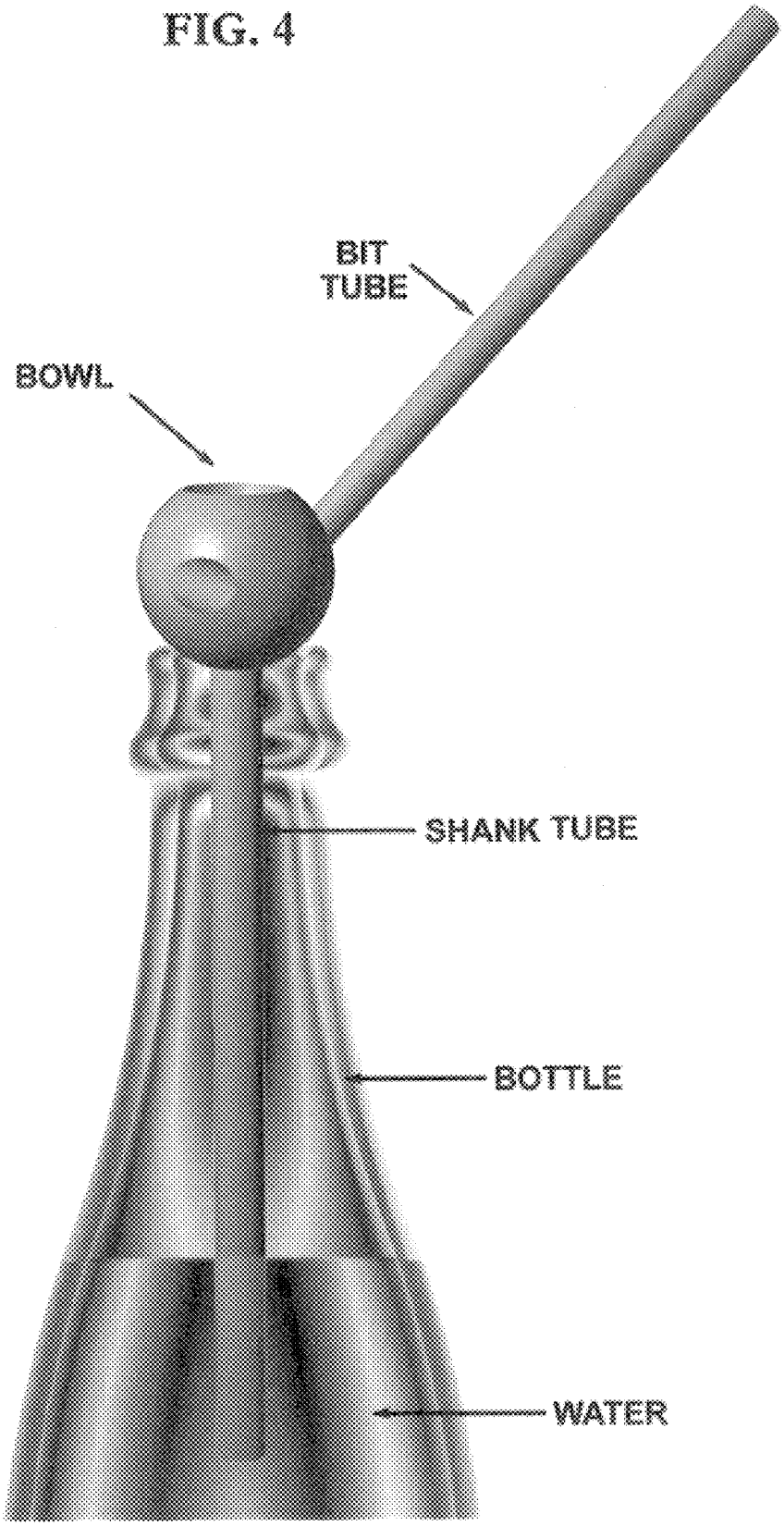
FIG. 4 is the same prespective view as 3/4 shown over the top of a section of a bottleneck with the tip of the shank immersed in the liquid contained.

An improved smoking waterpipe or bong comprising a spherical main body, on its upper portion there is a cavity (bowl) for combusting tobacco or medicinal herbs, the resulting smoke is directed through a tube (shank) inserted in the lower portion of the spherical main body extending vertically downwardly under the water level contained on a standard bottle, the spherical body formed to reside over the bottleneck of the bottle on gravitational force, creating a virtually airtight chamber, from this chamber the smoke will be inhalated through a second hole in the lower portion of the main spherical body connected to a cavity on the upper portion and through a tube inserted in this cavity to the mouth of the user.

What is claimed and desired to be protected by United States Letters Patent is:

1. A smoking pipe comprising:

a mouthpiece tube;

a shank tube;

a main spherical shaped body having an upper rounded conical indent cavity opening at a first upper location of said spherical shaped body and formed to be a bowl for holding combustible materials and where the combustion will take place, a first cylindrical receiving cavity opening at a second upper location of said spherical shaped body separate from said first upper location and formed for receiving said mouthpiece tube in a sealing and removable relation, a first air passage extending from an opening at a first lower location of the main spherical body to said first cylindrical receiving cavity, a second cylindrical receiving cavity having an opening at a second lower location of the spherical shaped body, formed for receiving in a sealing and removable relation said shank tube, such that said tube is extending vertically downwardly from said spherical shaped body, and a second air passage connecting said second cylindrical receiving cavity and an interior surface of said upper rounded conical indent cavity, wherein said spherical shaped body is formed and said first lower location and said second lower location are arranged such that when said spherical shaped body is placed over and in contact with a top opening of a standard beverage bottle such that said shank tube extends into the interior of said bottle a substantially air-tight seal is formed between said spherical shaped body and an outer rim of said top opening, and said first air passage is in communication with said top opening.

2. A smoking pipe as claimed in claim 1 in which said tubes could be removed for cleaning purpose.

* * * * *